United States Patent [19]

Wu

[11] 4,405,250

[45] Sep. 20, 1983

[54] ADJUSTABLE LOOSELEAF BINDER

[76] Inventor: Kuoeng F. Wu, 11704 Bunting Dr., Knoxville, Tenn. 37922

[21] Appl. No.: 296,149

[22] Filed: Aug. 25, 1981

[51] Int. Cl.[3] ..... B42F 13/02

[52] U.S. Cl. ..... 402/13; 402/15; 402/64; 402/69

[58] Field of Search ..... 281/23, 26; 402/13, 402/15, 17, 59, 64, 65, 66, 68, 69

[56] References Cited

U.S. PATENT DOCUMENTS

| | | | |
|---|---|---|---|
| 394,394 | 11/1888 | Ready | 402/17 X |
| 860,885 | 7/1907 | Proudeit, Jr. | 402/13 |
| 2,129,318 | 9/1938 | Emery | 402/59 |
| 2,355,223 | 8/1944 | Lotter | 402/65 |
| 2,804,872 | 9/1957 | Kraut | 402/68 X |
| 3,645,637 | 2/1972 | Gustafson | 402/15 |

*Primary Examiner*—Mark Rosenbaum

*Attorney, Agent, or Firm*—Pitts, Ruderman & Kesterson

[57] ABSTRACT

An adjustable looseleaf binder is provided for the accumulation of sheets of hole punched paper and the like. This binder has an elongated base plate to which are attached one end of a plurality of flexible binding posts. The second ends of the binding posts are releasably held in the base plate by various clamping mechanisms thereby providing an adjustable loop of any desired size. This loop threads through the hole, or selected holes, of material to be held in the binder. A foldable sheet provides for the top, edge and bottom cover of the binder. This sheet has prescored lines therein to permit folding to achieve the desired dimensions of the binder and holes to accept the binding posts. As the contents of the binder are changed, the cover may be folded at other prescored lines to accommodate this change. The components of the binder may be readily shipped in a compact manner and assembled by the user to achieve a binder of desired size. The manner of holding hole-punched material within the binder prevents the obscuring of information contained on the sheets along the edge adjacent to the holes and, in addition, permits the easy removal of material from the binder or the addition of more material to the binder. The construction accommodates a wide range of total thickness of sheets.

12 Claims, 14 Drawing Figures

ADJUSTABLE LOOSELEAF BINDER

DESCRIPTION

1. Technical Field

This invention relates generally to binders for holding an accumulation of hole-punched pages of paper and like material, and more particularly to an adjustable binder whereby widely varying amounts of material may be enclosed. The binder is designed so that no information on any particular page is obscured by the binding mechanism, and any sheet may be readily removed from or added to the binder without loss of other sheets. The binder is so designed that under no circumstances a sheet will accidentally slip out of the binder.

2. Background Art

A variety of binders are known in the art for encasing a collection of pages of paper and the like for combining the pages to facilitate filing thereof. These binders may generally be divided into three (3) major classes: the snap ring type; the adjustable height stud type; and the folding stud or post type of binder. Still another type of binder employs a pressure clamp.

Probably the most widely used binder is the snap ring type wherein two generally semicircular fingers, which are spring loaded, may be closed to produce a substantially circular ring which passes through holes placed in the edges of material to be bound. There is usually one such ring for each series of holes placed in the material. Although this construction permits a complete viewing of each page contained in the binder and permits the removable of any specific sheet from the bound material, it has several disadvantages. For example, the total capacity is limited by the size of the particular ring. If large amounts of material are to be accumulated and bound, a sizable ring binder is required. For the accumulation of small quantities of material, an entirely different binder must be utilized for the economy of storage space. Furthermore, the mating fingers that form each ring frequently become misaligned or do not completely close against one another. When this occurs, pages frequently slip between these fingers and become unattached from the ring. Furthermore, when the binder is filled to capacity, the pressure of the material contained therein may falsely open the ring and thus pages are lost from the binder.

Another frequently used binder, which is particularly adaptable to being adjusted to hold varying amounts of material, is what may be called a folding post binder. Such a binder is typified by the "Acco" type binder. In this construction, at least a pair of flexible flat metal posts pass through the punched hols of the paper or other materials to be bound, with a clasp fitting over these posts, whereby the posts may then be folded and grasped by the clasp to prevent loss of material from the binder. Although this binder construction does permit enclosing varying amounts of material, the construction has the disadvantage that any material printed or otherwise contained near the margin wherein the punched holes are located is obscured by the binding mechanism. Furthermore, if material is to be removed from the center of pages contained in the binder, the entire contents on one side of that material must be removed in order to make this individual removal. Also, the thin metal binding posts are subject to breakage after numerous folding operations. Unless the clamp is properly placed, the binder may open accidentally when extremely full.

The adjustable height stud type of binder combines some of the features of both the ring type and the folding stud type binder. The individual studs are lengthened or shortened by the addition of (or the removal of) threaded sections of the studs. These studs may include a loop at the top to bridge a pair of posts such that the material contained in the binder is loosely held in a manner similar to the ring type binder. Typical of this construction is the binder of U.S. Pat. No. 2,129,318 issued to G. S. Emery on Sept. 6, 1938. Additional sections of the studs must be maintained in order to increase capacity of the binder when desired. Furthermore, this particular construction is relatively expensive because of the fabrication of the stud components.

Probably the least used of the types of binders is the clamp type wherein a lever or spring operated bar clamps material within the binder. This binder suffers from basically the same disadvantages as the folding stud binder. That is, it obscures material that may be on the pages to be bound along the edge of binding, and the entire contents of the binder must be removed if a page is to be removed from the middle of the bound material.

It is therefore an object of the present invention to provide a simple, adjustable looseleaf binder for the accumulation of sheets of paper and the like having holes punched at a specific spacing along one edge.

It is another object to provide a ring type binder whereby no information contained on any of the bound material is obscured from view and material may be easily removed from the body of the bound material.

It is still another object of the present invention to provide a binder wherein a flexible post, attached at one end to a base plate, is provided to thread the holes punched in the material to be bound and provides for the clasping of the second end of the post within the base plate.

It is a further object of the invention to provide a binder having a unitary cover which forms the top, bottom and the edge of the binder; this cover having pre-scored lines to permit bending and thereby selecting a binder of varying thicknesses.

Other objects and advantages of the invention will become apparent upon reading the detailed description and reference to the drawings.

DISCLOSURE OF THE INVENTION

In accordance with the invention, an adjustable looseleaf binder is provided for the accumulation of sheets of paper and like material having punched holes along at least one edge thereof. The binder has an elongated base plate with two rows of parallel apertures extending at least a portion of the dimension through the base plate. One end of a flexible post is secured in the apertures in one row along the base plate, with the second end of each post insertable through the corresponding aperture in the second row of apertures and into a passageway extending along the length of the base plate and communicating with those second apertures. The base plate further includes clamping means for holding the second end of the flexible posts at the desired position thereby the flexible posts form a loop or ring of the desired size for the holding of a specific quantity of material in the binder. A single sheet of material, prescored at numerous positions near its midpoint, is folded over the base plate to form a front, edge, and back cover of the binder. Holes in this sheet cover permit passage of the flexible posts in a manner similar to that of the material contained within the binder. This construction permits the shipment of the components for binders in flat packages and the assemblage thereof by the end user.

BEST MODE FOR CARRYING OUT THE INVENTION

Figure 1:
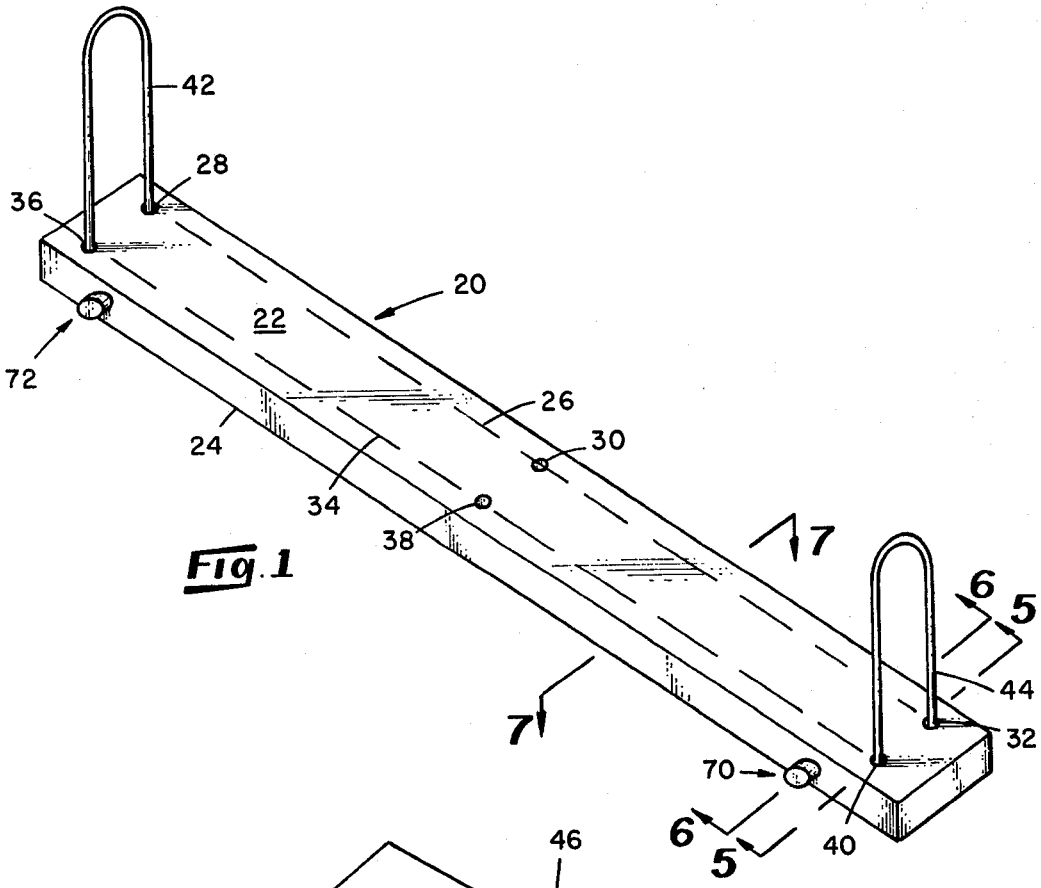
FIG. 1 is an isometric drawing illustrating the base plate of the subject adjustable binder containing a pair of U-shaped flexible posts for securing punched material within the binder.

The present invention comprises two essential components. The first is a base plate with its attached posts as illustrated in FIG. 1. The second is a foldable cover which is illustrated in FIG. 2.

Referring first to FIG. 1, the base plate 20 is an elongated, generally rectangular member having a thickness defined by an upper surface 22 and a lower surface 24. Lying along a line 26 on the upper surface of the base plate are a plurality of apertures normal to that surface such as 28, 30, and 32. The spacing between these apertures corresponds to the spacing between the holes in material to be encased in the binder. It will be understood that additional apertures may also be provided as discussed hereinafter. These apertures 28 through 32 extend through at least a portion of the thickness of the base plate 20. Along a second line 34, parallel to line 26, are corresponding apertures 36, 38, and 40. Additional apertures would be provided if additional apertures are provided along the first line. A pair of flexible binding posts 42, 44 are shown extending above the top surface 22 of the base plate 20. Post 42, for example, loops between aperture 28 and aperture 36. Post 44, in a similar manner, loops between aperture 32 and aperture 40. If desired, a third binding post might be provided which would loop between aperture 30 and aperture 38 of the base plate 20. It will be readily understood that these binding posts are for the purpose of threading through the holes punched in the edge of material to be retained with the binder. Further detail of each post is shown in FIG. 5.

Figure 2:
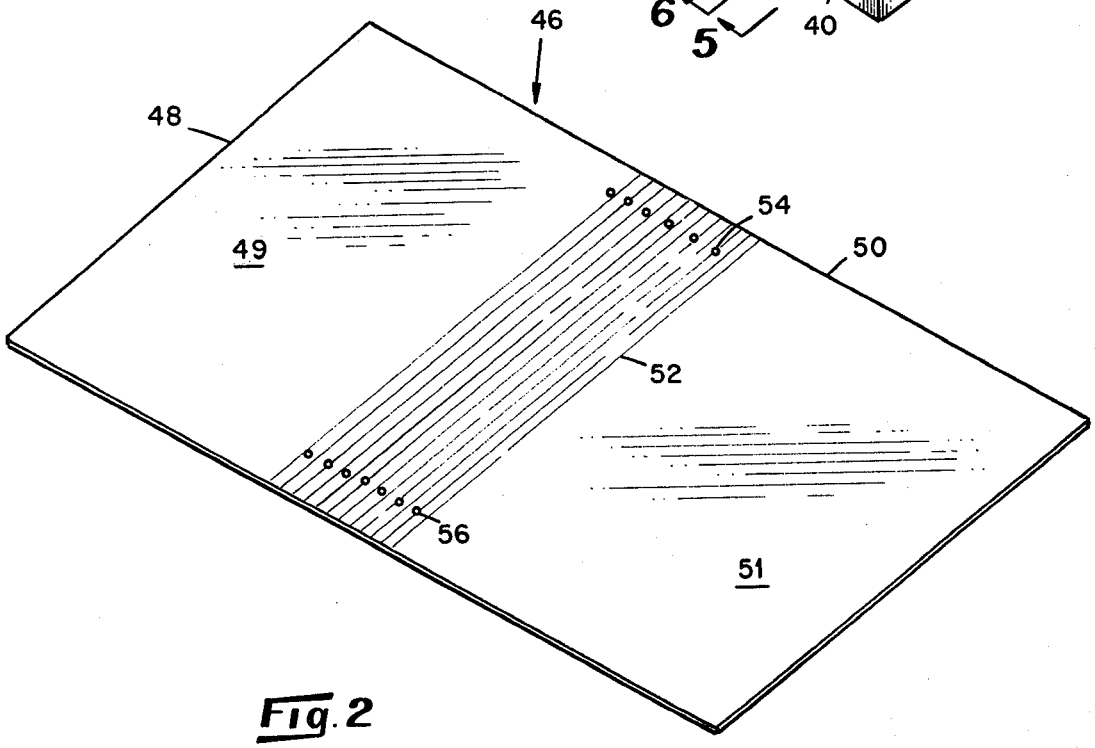
FIG. 2 is an isometric view of the single sheet cover for the subject adjustable binder illustrating the prescored lines for the folding of this cover.

The cover element 46 of the present invention is illustrated in FIG. 2. As shown, this is a unitary sheet of material having a desired thickness to provide a selected degree of flexibility. The width 48 of this sheet is selected to be sufficient to embrace the length of the base plate 20 and any sheets of material contained on the posts 42 and 44 of the binder. The length of the cover sheet, designated as 50, is selected to provide sufficient material for the front and back cover of the binder as well as the edge cover. Prescored lines 52 extend across the width of the sheet 46 near the center thereof and are provided for facilitating the folding of the cover into a binder of desired configurations. Two series of punched holes 54 and 56 are provided to receive the above referenced binding posts 42 and 44. If additional binding posts are utilized, corresponding punched holes are provided in the sheet 46. Portions 49 and 51 of the cover 46 which do not contain prescored lines may, if desired, be of greater thickness to provide stiffness to the binder.

Figure 3:
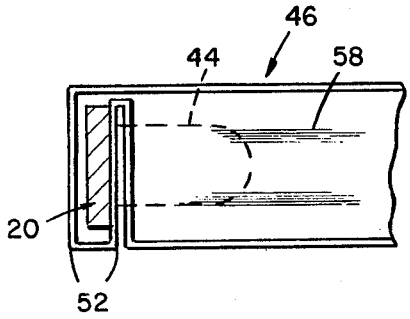
FIG. 3 is a cross-sectional view showing one embodiment of the cover and the base plate for the holding of hole punched material.
Figure 4:
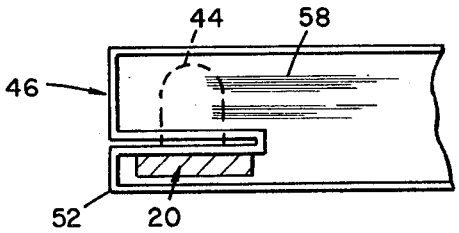
FIG. 4 is a cross-sectional view of another embodiment of the folded cover and the base plate for securing hole-punched material.

Two typical configurations of the present invention are shown in FIGS. 3 and 4. In FIG. 3, the base plate 20 is oriented perpendicularly to the plane of the binder when assembled to hold pages 58. This construction provides for a binder of fixed thickness to minimize storage space on a shelf. It is particularly useful for the binding of computer printout sheets. Both edge and top labeling are convenient. In FIG. 4, the base plate is oriented to be parallel with the plane of the finished binder. This construction provides for a fixed depth on a shelf, with the thickness varying. Edge labeling is facilitated. The choice of the configuration is permitted by the aforementioned prescored lines 52 on the cover sheet 46. The selection depends upon the particular material that is to be bound by a user and the available storage facility.

Figure 5:
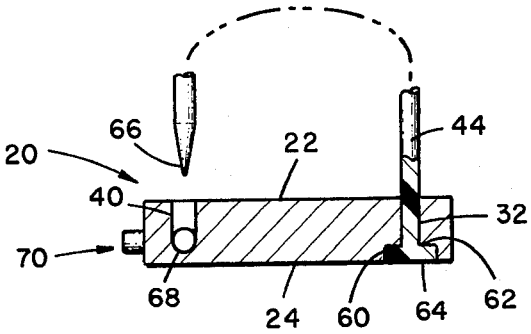
FIG. 5 is a cross-sectional view taken at 5—5 of FIG. 1 showing the construction of one of the U-shaped binding posts.

Referring now to FIG. 5, a typical construction of a binding post is illustrated. In this particular embodiment, the aperture 32 is provided with a countersink 60 in the lower surface 24 of the base plate 20. This countersink thereby forms a shoulder 62. The extreme first end of the post 44 is provided with an enlarged head 64 which fits within the countersink 60 and against the shoulder 62. The extreme second end 66 of the post 44 is preferably tapered as shown to facilitate entry into the aperture 40 and then into a longitudinal passageway 68 formed within the base plate 20. The base plate 20 is provided with a clamp 70 which communicates with the passageway 68 for the purpose of grasping the second end of the post 44 when it is inserted within the passageway 68. It may be seen by referring back to FIG. 1 that a second clamping device 72 is provided to grasp the second end of post 42 when inserted in an appropriate passageway. One clamp is thus provided for each binding post inserted in the base plate 20.

Figure 6:
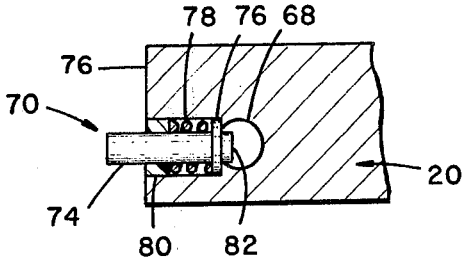
FIG. 6 is a cross-sectional view, partially cut away, showing one embodiment of a clamping means for securing a second end of the binding posts into the base plate.

One embodiment of a clamping device 70 is illustrated in FIG. 6. It may be seen in this figure that a piston 74 extends from beyond the edge 76 of the base plate 20 into the base plate and enters the side of the passageway 68. This piston 74 is provided with an annular shoulder 76, and a spring 78 encircling the piston 74 bears against this shoulder as well as a shoulder formed by the annular insert 80. According to this construction, the spring 78 biases the piston 74 to normally intercept the passageway 68. If, however, a binding post (not shown) is inserted in the passageway 68, the inner end 82 of the piston 74 bears against this binding post and restricts any axial movement thereof in the passageway 68. When it is desired to remove the binding post from the passageway 68, the piston 74 may be moved axially to compress the spring 78 thereby disengaging the end 82 from the binding post.

Figure 7:
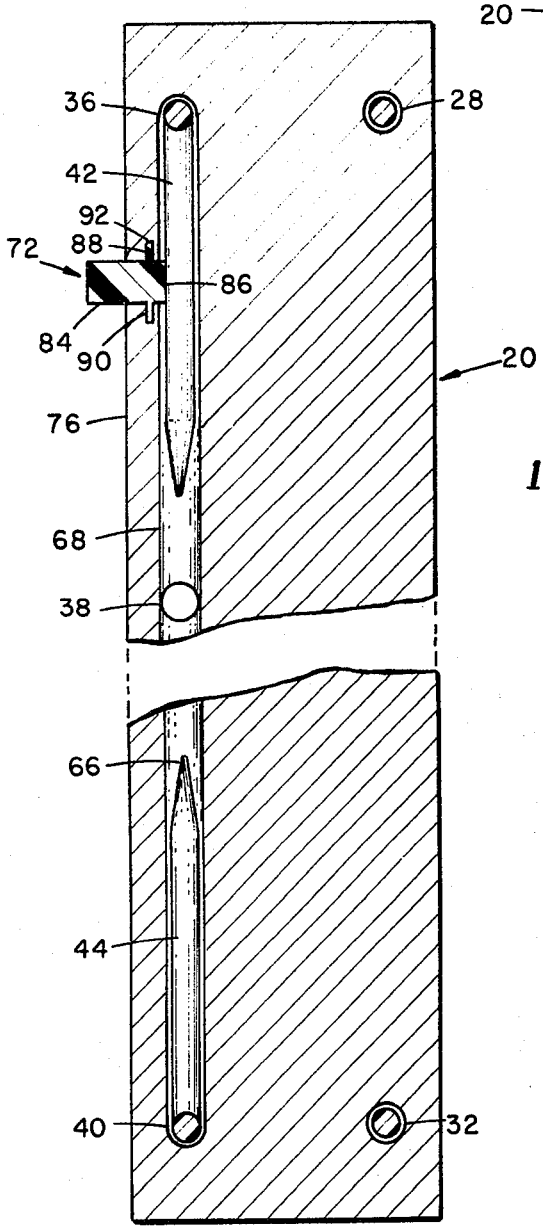
FIG. 7 is a longitudinal cross-sectional view of the base plate taken at 7—7 of FIG. 1 illustrating the passageway into which the second ends of the binding posts are inserted, and a second means for clamping this second end within the base plate.
Figure 8:
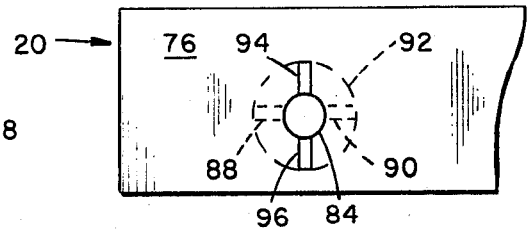
FIG. 8 is a partial plan view of an edge of the base plate of FIG. 7 further illustrating the clamping means used for holding the second end of the post within the base plate.

FIG. 7 is a longitudinal cross-section of the base plate 20 showing more clearly the passageway 68 and a second embodiment of a clamp 72. In this embodiment, the passageway 68 is shown as extending the entire length of the base plate 20 from aperture 36 to aperture 40. Alternatively, the passageway may be broken up into segments with one segment for each of the apertures 36, 38, and 40. The clamping means 72 illustrated in this figure consists of a piston 84 entering the edge 76 of the base plate 20 and extending into the passageway 68 where the extreme end 86 of the piston will bear against the second end of the binding post 42. The piston is provided with a pair of radially extending fingers 88 and 90 that extend into an annular recess 92. Alternatively, these fingers may bear against the inner surface of passageway 68. This construction is more clearly seen in FIG. 8. The edge 76 of the base plate 20 is provided with a pair of opposed slots 94, 96, through which the fingers 88 and 90 of the piston 84 may be inserted whereby these fingers fit within the annular recess 92. When it is desired to disengage the clamping means 72 from the binding post 42, the piston 84 is rotated whereby the fingers 88, 90 are aligned with the slots 94, 96 permitting the piston 84 to be axially moved away from the post 42 and thereby allow binding post 42 to be withdrawn or repositioned within the passageway 68.

Figure 9:
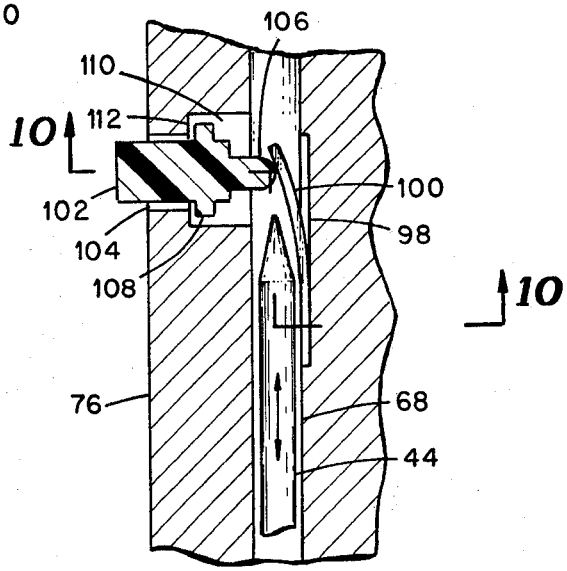
FIG. 9 is a cross-sectional view of another embodiment of means for securing the second end of the binding posts within the base plate.
Figure 10:
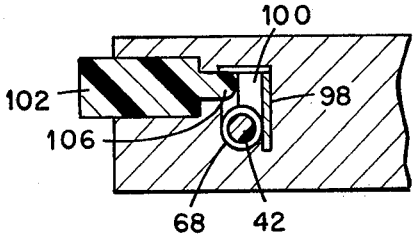
FIG. 10 is a transverse sectional view taken at 10—10 of FIG. 9 showing this embodiment.

Still another embodiment of a clamping means for the binding posts 42 and 44 (and any other binding posts) is illustrated in FIGS. 9 and 10. As shown therein, the passageway 68 is provided with an enlarged portion 98. Into this enlarged portion is fastened a flat spring 100 which is curved to normally extend across the passageway 68. Whenever a binding post, such as 44 is inserted within the passageway 68, the spring 100 is deflected to accept this binding post. However, the pressure of the spring against the binding post restricts removal of this post from the passageway. In order to remove the spring 100 from contact with the binding post 44, a piston 102 is provided within opening 104. This piston 102 terminates in an inner end 106 which normally bears against the spring 100. The piston 102 is set in a plane that does not intersect the passageway 68 (See FIG. 10) whereby the inner end 106 will not itself contact the binding post 44 when it is in passageway 68. The piston 102 is provided with a shoulder 108 which moves within a countersunk region 110 thereby providing a shoulder 112. The spring 100 normally maintains the shoulder 108 of the piston against the shoulder 112. However, the countersunk region 110 permits axial movement of the piston 102 such that the inner end 106 depresses the spring 100 into the recess 98 thereby releasing the post 44 from contact with the spring 100. Thus, the second end of the binding post may be removed from, or repositioned in, the passageway 68.

Figure 11:
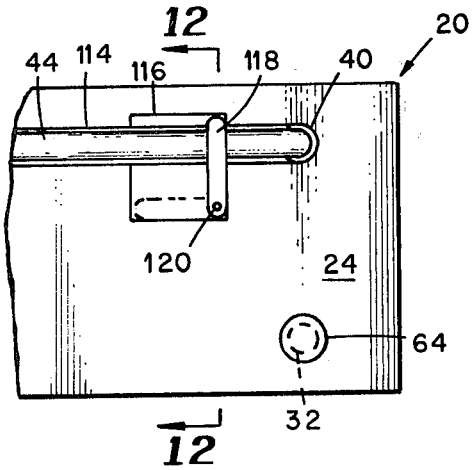
FIG. 11 is a bottom view of the base plate of FIG. 1 illustrating a passageway formed in the bottom surface for receiving the second end of the binding post, and an additional clamping means for this second end of the posts.
Figure 12:
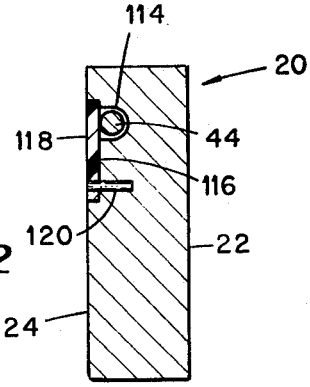
FIG. 12 is a cross-sectional view of the construction of FIG. 11 taken at 12—12 thereof.

A further embodiment of the invention, particularly with regard to the method of clamping the end of a flexible binding post within the base plate, is illustrated in FIGS. 11 and 12. As shown therein, a recess 114 is formed in the bottom surface 24 of the base plate 20. This recess communicates, for example, with aperture 40 which in turn extends to the top surface of the base plate. In addition, a generally rectangular recess 116 intercepting recess 114 is also formed in the bottom surface 24. Positioned within this rectangular recess 116 is a clamping arm 118 pivotable about a pin 120 at one end thereof. The clamping arm 118 is shown in solid lines in a position wherein it retains a binding post 44 within the recess 114. When the clamping bar is rotated to the position shown with dashed lines, the binding post 44 is free to be moved from the recess 114. It will be readily recognized that a corresponding clamping bar will be utilized for each of the posts contained within the base plate 20. Furthermore, the longitudinal recess 114 may extend from one extreme aperture to the other extreme aperture of a row of apertures in the base plate. Alternatively, the recess 114 may be segmented with each segment corresponding to an aperture for the receiving of an end of a binding post. Furthermore, recesses 114 and 116 may be of sufficient depth whereby a lip (not shown) formed in the bottom surface 24 will retain the second end of clamping bar 118 when in a locking position.

Figure 13:
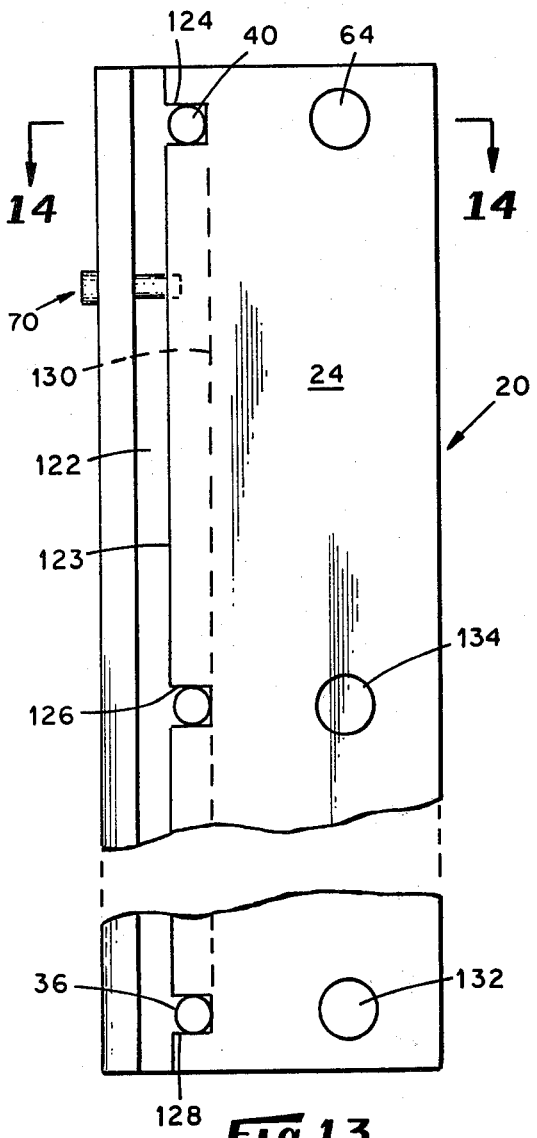
FIG. 13 is a bottom view of a base plate of the invention illustrating another embodiment of means for securing the second ends of flexible binding posts.
Figure 14:
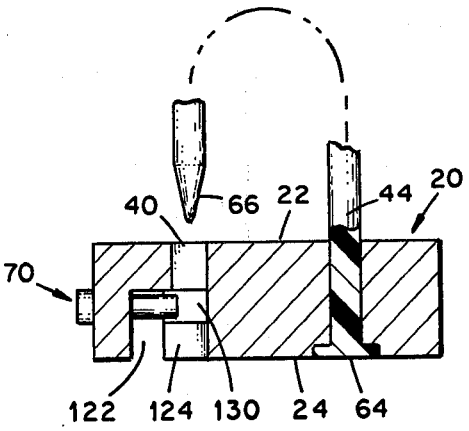
FIG. 14 is a cross-sectional view of the embodiment of FIG. 13 taken at 14—14 thereof.

Still another embodiment of a base plate 20 for use with the present invention is illustrated in FIGS. 13–14. This embodiment may be preferred on the basis of standard extrusion, molding and punching operations during fabrication. Referring to FIG. 13, the bottom surface 24 of the base plate 20 is provided with lengthwise main channel 122. Transverse or cross channels 124, 126 and 128 connect to channel 122 and intersect, respectively, apertures 40, 38 and 36. A lengthwise groove 130 (see FIG. 14) opens from the side 123 of channel 122. This groove 130 extends from aperture 36 to aperture 40, and is generally aligned with these apertures as shown. The depth of the groove, as measured from the channel 122, is selected to accomodate the number of posts to be utilized with a specific binder. This drawing also illustrates the enlarged head 64 of binding post 44, as well as enlarged heads 132, 134 of two additional binding posts.

This construction is further illustrated in FIG. 14. When a loose end of a binding post is to clamped in the base plate 20, end 66 thereof is inserted through aperture 40 into the cross channel 124. The binding post is then bent to be oriented lengthwise in channel 122 and subsequently forced into the groove 130. Any suitable clamp 70 (such as shown in FIGS. 6, 7, and 9) is used to retain this binding post within groove 130.

The present binder is designed so that components may be delivered to a user in kit form with the cover 46 unfolded. The base plate 20 would be assembled with the appropriate clamping device, and the binding posts (such as 42 and 44) would be separated therefrom and ultimately inserted by a user. When assembly is contemplated, the user folds the cover 46 along the prescored lines 52 to accomplish a cofiguration such as shown in either FIGS. 3 or 4. One end of each of the binding posts is then inserted in the base plate and a desired quantity of hole-punched material is inserted over the binding posts. Thereafter, the second end of the binding posts is inserted into the appropriate passageway of the base plate and clamped to provide a desired looseness of the contents of the binder. When it is desired to add additional material to the binder, or to remove a specific page or pages, the binding posts are loosened from the clamping device and withdrawn from the base plate. This permits the addition of pages or the removal of specific pages. Thereafter, the post loose ends are again inserted into the base plate and clasped therein with the appropriate clamping devices. It will be readily recognized that the present invention is not limited to any particular size or shape. It would be manufactured to encompass conventionally sized sheets of hole punched paper, for example, including computer printer output paper. Whenever the capacity of the binder is to be changed the cover can be folded at other of the prescored lines to accomodate this adjustment. Furthermore, the capacity of the loop type binding post can be adjusted to accomodate this change.

The present invention is not limited by the size, or the materials of construction, of the components. Typically, however, the base plate 20 may have a length corresponding to the size of sheets to be held in the binder. Normal sheets of notebook paper are $8\frac{1}{2}\times 11$ inches; thus, a typical length of base plate is about eleven inches with the cover 46 extending $\frac{1}{4}$–$\frac{1}{2}$ inch therebeyond. Since computer papers are 15 inches long, the base plate may be of that length with the cover being correspondingly longer. The spacing of the apertures conforms to the conventional spacing of holes in either of these conventional papers. The apertures may be, for example, 5/32 inches in diameter, and the binding posts may be $\frac{1}{8}$ inch in diameter. The thickness of the base plate is typically $\frac{1}{2}$ inch.

The base plate may be fabricated of any suitable material. Typically, acrylic sheet or polyvinyl chloride (PVC) plastic may be used. The cover may be fabricated from PVC or other suitable material, and the posts may be fabricated from nylon or the like. The clamping devices may be fabricated from PVC, nylon, etc. The choice of materials will be dependant upon the operations utilized in the fabrication of the components.

From the foregoing description, it will be recognized that an adjustable looseleaf binder is provided for use with hole punched paper or the like. This binder may be adjusted to accumulated various quantities of material with the cover and the binding posts being adjustable for this various accomodation. It is readily manufactured in various sizes and may be shipped with the cover unfolded whereby large quantities of the binders may be shipped in a minimal space. The construction prevents inadvertant loosening of the looped binding posts when the binder is relatively full. However, it readily permits the removal of sheets of material from within the contents of the binder. Because of its construction, the binder does not obscure material that may appear along the border of the enclosed material near the punched holes. Also, it permits labeling the edge and either side of the cover depending upon the embodiment.

It is of course understood that although preferred embodiments of the present invention have been illustrated and described, various modifications thereof will become apparent to those skilled in the art. Accordingly, the scope of the invention should be defined only be the appended claims and the equivalents thereof.

I claim:

1. An adjustable looseleaf binder for the releasable accumulation of sheets of paper and the like having holes punched at a specific spacing along one edge thereof, which comprises:

an elongated base plate having a thickness defined by substantially parallel top and bottom surfaces, said base plate being provided with parallel first and second rows of apertures along its length extending from said top surface through at least a portion of said thickness, the spacing between apertures in each of said rows corresponding to said selected spacing of punched holes, said base plate being further provided with a passageway substantially oriented along the length of said base plate communicating with each of said apertures in said second row;

a plurality of unitary flexible binding posts to penetrate such punched holes, one end of each of said binding posts being secured in a selected one of said apertures in said first row; and a locking element associated with said passageway for releasably engaging a second end of said binding posts when said second end is inserted within said passageway.

2. The looseleaf binder of claim 1 wherein each of said apertures of said second row is provided with a separate passageway oriented along the length of said base plate and each of said separate passageways is provided with said locking element.

3. The looseleaf binder of claims 1 or 2 wherein said passageway is a recess formed in said bottom surface of said base plate.

4. The looseleaf binder of claims 1 or 2 wherein said passageway is intermediate said top and bottom surfaces of said base plate.

5. The looseleaf binder of claim 1 wherein said locking element comprises an axially moveable piston mounted within said base plate adjacent said passageway, and holding means for releasably engaging one end of said piston against said second end of said binding post when said second end of said binding post is inserted into said passageway.

6. The looseleaf binder of claim 5 wherein said holding means comprises a biasing spring interposed between said base plate and said piston.

7. The looseleaf binder of claim 5 wherein said holding means comprises a radial projection on said piston and a shoulder within said base plate, said radial projection and said shoulder being engageable upon rotation of said piston.

8. The looseleaf binder of claim 7 wherein said unitary sheet is provided with parallel prescored lines across its width for permitting folding of said sheet to accomodate a selected range of number of sheets of said punched paper and the like within said binder.

9. The looseleaf binder of claim 1 further comprising a unitary sheet forming a front, edge, and rear cover for said binder having a width and a length sufficient to enclose said hole-punched paper and the like, said sheet being provided with holes to accept said binding posts.

10. The looseleaf binder of claim 1 wherein said apertures of said first row penetrate said thickness of said base plate and are provided with a aperture shoulder adjacent said bottom surface, and wherein said first end of said binder posts is provided with an enlarged head to engage said aperture shoulder.

11. The looseleaf binder of claim 1 wherein said second end of said binding posts is reduced in size to facilitate entry into said passageway.

12. The looseleaf binder of claim 1 wherein said bottom surface of said base plate is provided with a main channel along the length thereof and cross channels substantially perpendicular to said main channel intersecting said apertures of said second row, and wherein said main channel is provided with a longitudinal groove intermediate said top and bottom surfaces of said base plate, said longitudinal groove intersecting said apertures of said second row, said main channel and said groove thereby forming said passageway.

* * * * *